United States Patent [19]

Huntzinger et al.

[11] Patent Number: 4,903,675

[45] Date of Patent: Feb. 27, 1990

[54] INTERNAL COMBUSTION ENGINE IGNITION APPARATUS HAVING A PRIMARY WINDING MODULE

[75] Inventors: Dwayne A. Huntzinger, Pendleton; Thomas E. Welsh, Jr.; James A. Boyer, both of Anderson, all of Ind.

[73] Assignee: General Motors Corporation, Detroit, Mich.

[21] Appl. No.: 322,373

[22] Filed: Mar. 13, 1989

[51] Int. Cl.[4] ..... F02P 3/00

[52] U.S. Cl. ..... 123/635; 123/647

[58] Field of Search ..... 123/635, 647, 143 R, 123/143 C, 146.5 R, 169 PA, 594, 634, 636, 637; 315/57, 266

[56] References Cited

U.S. PATENT DOCUMENTS

| | | | |
|---|---|---|---|
| 4,172,439 | 10/1979 | Pasbrig | 123/635 |
| 4,617,907 | 10/1986 | Johansson et al. | 123/647 |
| 4,637,368 | 1/1987 | Gillbrand et al. | 123/647 |
| 4,665,922 | 5/1987 | Gillbrand et al. | 123/647 |
| 4,671,248 | 6/1987 | Gillbrand et al. | 123/647 |
| 4,700,638 | 11/1987 | Johansson et al. | 123/647 |
| 4,706,639 | 11/1987 | Boyer et al. | 123/647 |
| 4,834,056 | 5/1989 | Kawar | 123/635 |

*Primary Examiner*—Raymond A. Nelli

*Attorney, Agent, or Firm*—C. R. Meland

[57] ABSTRACT

Ignition apparatus for developing and applying sparks to the cylinders of an internal combustion engine. A plurality of a secondary spark developing units are respectively associated with the cylinders of the engine. Each secondary unit comprises a spark plug and a secondary winding carried by the spark plug that is connected to the electrodes of the spark plug. Magnetic flux is coupled to the secondary winding of the secondary units by a primary winding module. The module has a support portion and a plurality of spaced tubular members. A primary coil having a bore is located in each tubular member. A tubular flux carrying part formed of magnetic material is located about each primary coil. The module is supported by the engine in such a position that portions of the secondary units project into the bores when the module is mounted on an engine.

12 Claims, 5 Drawing Sheets

INTERNAL COMBUSTION ENGINE IGNITION APPARATUS HAVING A PRIMARY WINDING MODULE

This invention relates to ignition apparatus for developing sparks that are applied to the cylinders of an internal combustion engine and more particularly to such apparatus that includes a primary winding module that has a plurality of primary windings that cause voltages to be induced in the secondary windings of a plurality of secondary winding units that are associated with the cylinders of the engine.

A known type of integrated ignition system that utilizes an ignition module that is secured to an engine where the module has means for making electrical connections to the spark plugs of the engine is disclosed in the U.S. Pat. No. to Boyer et al. 4,706,639. In that patent a plurality of ignition coils are contained within the module and the secondary windings of the coils are connected to the spark plugs. The module of that patent further has a plurality of connector assemblies which fit over the spark plugs which include means for making an electrical connection to a terminal of a spark plug.

The ignition apparatus of this invention, like the apparatus disclosed in the Boyer et al. patent, includes a module that is secured to the engine. However, unlike the module disclosed in the Boyer et al. patent, the module of this invention does not support a plurality of ignition coils that have secondary windings. Thus, the primary winding module of this invention has a plurality of spaced primary windings each of which defines a bore. The primary windings are adapted to cooperate with a plurality of secondary units, where each secondary unit includes a spark plug and a secondary winding carried by an insulator of the spark plug. When the primary module is secured to an engine the bores of the primary windings are slipped over the portions of the secondary units that have the secondary coil windings. When the primary windings are energized, voltages are induced in the secondary windings of the secondary units by magnetic coupling of the flux developed by the primary windings to the secondary windings.

It accordingly is one of the objects of this invention to provide an ignition module that is adapted to be secured to an engine that has a plurality of spaced primary windings that are adapted to be magnetically coupled to a plurality of separate secondary winding units, where each secondary unit includes a spark plug and a secondary winding.

Another object of this invention is to provide ignition apparatus of the type described where the primary windings are associated with tubular parts formed of magnetic material that provide flux paths for the flux developed by a primary winding and wherein the secondary units have a magnetic core located within a secondary winding for providing a flux path for flux developed by a primary winding.

Still another object of this invention is to provide ignition apparatus of the type described where the primary windings of the primary winding module are energized by a capacitor discharge type of ignition system.

Another object of this invention is to provide apparatus for developing sparks that are applied to the cylinders of an internal combustion engine that has a primary winding module that includes a plurality of spaced primary windings, each of which has a bore and wherein the primary module is secured to an engine in such a position that the bores receive the ends of respective secondary units where each secondary unit comprises a spark plug have a threaded portion threaded into a respective engine spark plug opening and an insulator that carries a secondary winding and further wherein the secondary winding of a respective secondary unit is located within a respective bore of a primary winding.

IN THE DRAWINGS

Figure 1:
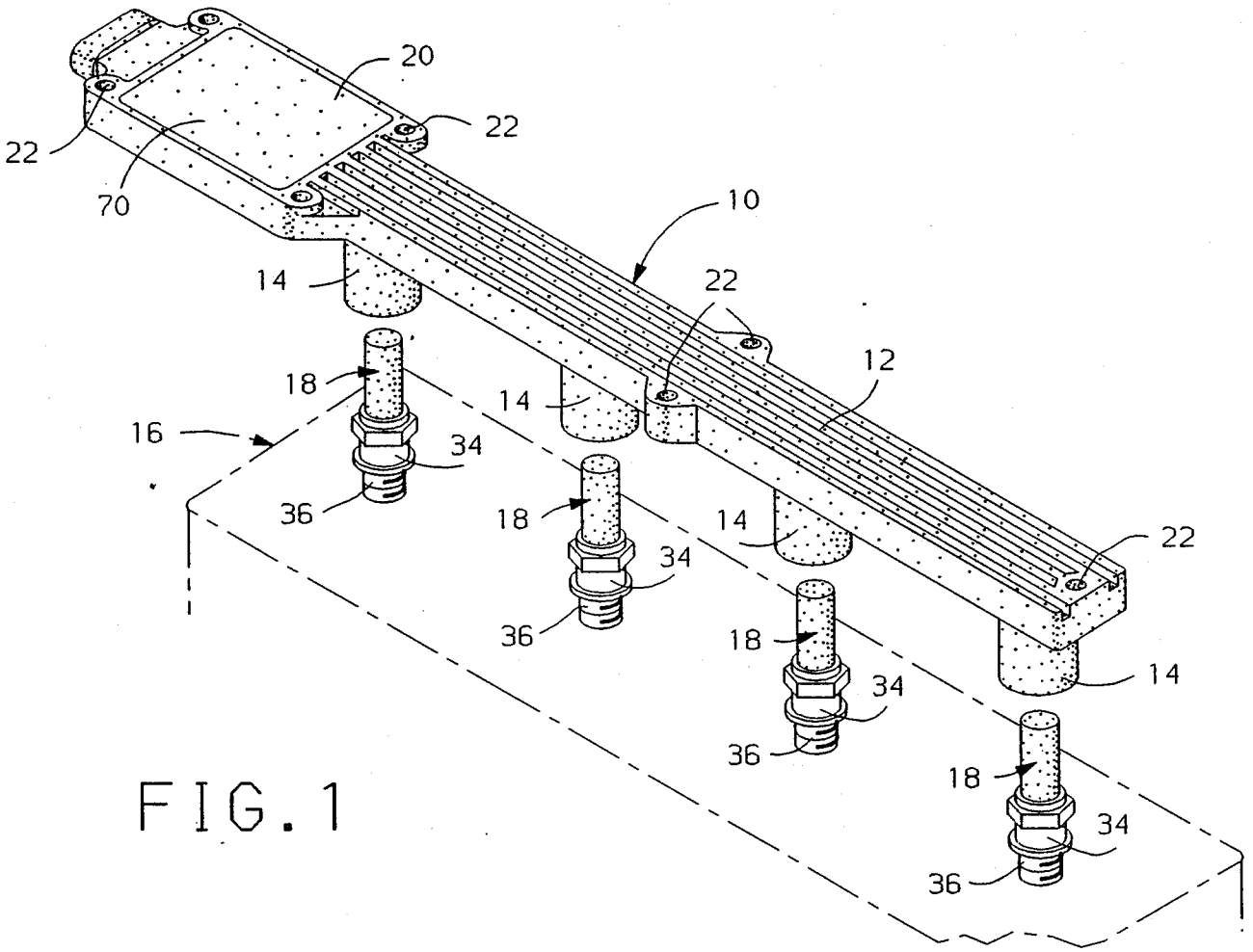
FIG. 1 is a perspective view of a primary module made in accordance with this invention shown associated with a plurality of separate secondary units.

Referring now to the drawings and more particularly to FIG. 1, reference numeral 10 generally designates a primary winding module made in accordance with this invention. This module includes an elongated body or support portion 12 that is formed of a plastic insulating material and which has four spaced integral tubular portions, each designated as 14. These tubular portions 14 each support a primary winding having a bore in a manner that will be described. In FIG. 1, reference numeral 16 designates a four cylinder internal combustion engine that has four threaded spark plug openings, each of which communicates with a respective cylinder of the engine. Threaded into these spark plug openings are the threaded ends of four secondary units, each of which is designated as 18. Each secondary unit, as will be described, is comprised of a spark plug that has an insulator that carries a secondary winding that is connected to the electrodes of a spark plug. Further, as will be described, each secondary unit has a magnetic core located inside of a secondary winding.

The primary windings of module 10 are connected to a capacitor discharge ignition system that is located in area 20 of module 10 by conductors that extend through portion 12.

In use, the secondary units 18 are threaded into the appropriate spark plug openings in engine 16. The module 10 is then secured to engine 16 by bolts or screws (not illustrated) that pass through openings 22. When securing module 10 to engine 16 the tubular portions 14 are slipped over the upper ends of secondary units 18 such that in the final assembled position of module 12 the upper ends of units 18 are telescoped into the bores of the primary windings located in tubular portions 14 with a respective primary winding encircling a respective secondary winding on a secondary unit.

Figure 2:
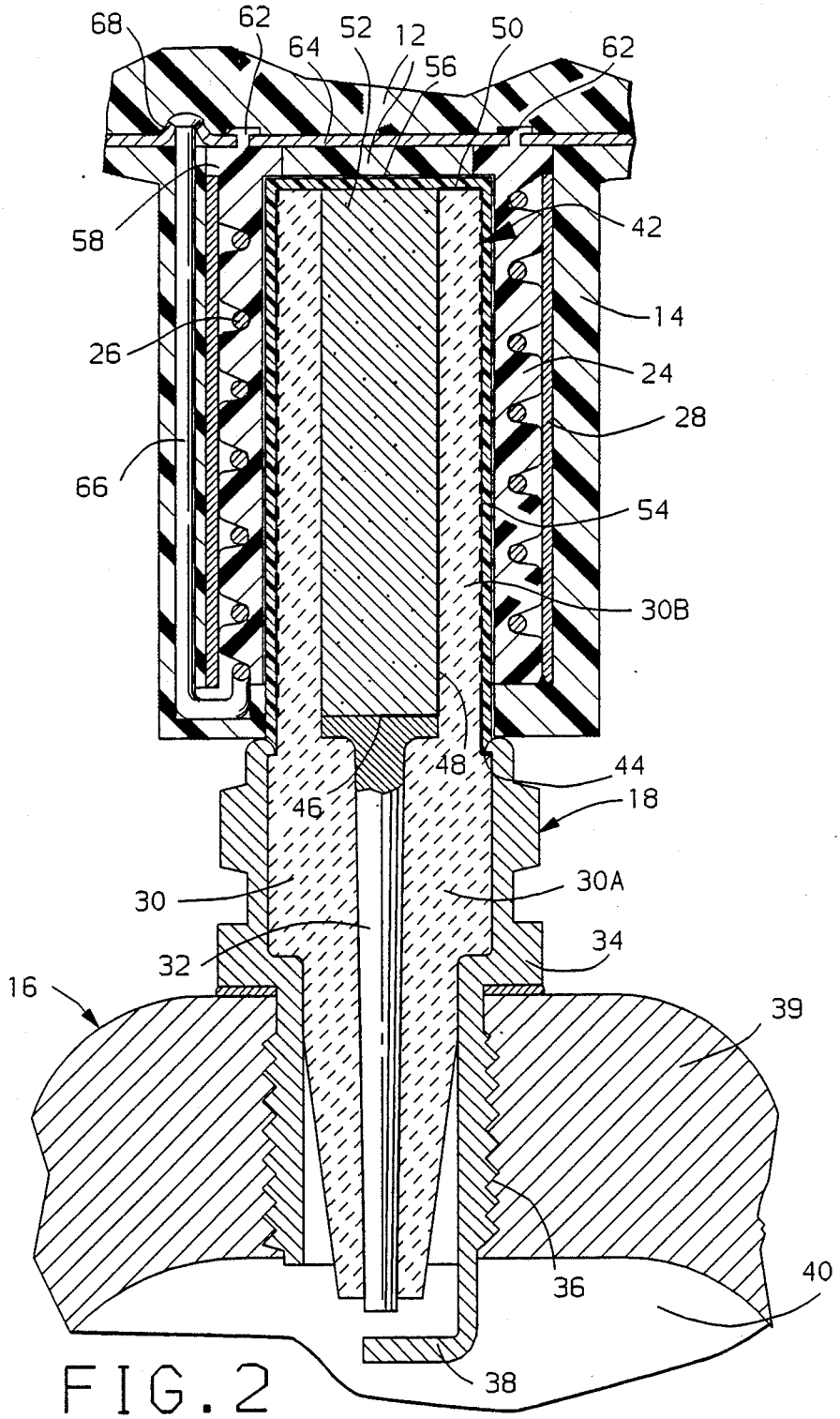
FIG. 2 is a sectional view illustrating the manner in which a primary winding of the primary module shown in FIG. 1 is associated with a secondary unit.

Referring now to FIG. 2, one of the primary windings contained in a tubular portion 14 of module 10 is shown associated with one secondary unit 18. It is seen that tubular portion 14 and body portion 12 support a coil support or coil spool 24 that is formed of a molded plastic insulating material. This coil spool has an outer spiral groove into which is wound a primary winding 26 formed of a plurality of turns of wire. By way of example, the primary winding 26 may be comprised of seven turns of wire. Tubular portion 14 also contains a tubular part 28 that is formed of magnetic material. This part is disposed about coil 26 and forms a low reluctance flux path for flux developed by coil 26. The part 28 may be formed of steel or compacted powdered iron. Where it is formed of steel it may be slitted axially to permit it to expand when it is press fitted to outer surfaces of spool 24. After press fitting the part 28 to spool 24, these parts are overmolded with plastic material to form tubular portion 14 in a manner to be described.

In FIG. 2, one of the secondary units is generally designated as 18 and it will now be described in detail. The unit 18 has an insulator 30 that is formed of a ceramic material that can be of the same type that is used for spark plug insulators. The insulator 30 has a portion 30A that supports a center metallic electrode 32 and outer tubular metallic shell 34 having a threaded portion 36. The shell 34 carries an electrode 38 that is in spark gap relationship to the end of electrode 32. The threaded portion 36 is shown threaded into a threaded spark plug opening in the head 39 of engine 16. The spark gap is located in one of the cylinders or combustion chambers 40 of the engine.

The insulator 30 has a tubular portion 30B that has an internal bore and an outer cylindrical surface. The outer surface of portion 30B carries a secondary coil winding 42 that is comprised of a number of spiral turns of metallic material that is bonded to the outer surface of portion 30B. The coil winding 42 may be formed by known metallizing processes. For example, winding 42 may be printed onto the outer surface of portion 30B. Another way of forming winding 42 is to coat, plate or deposit the outer surface of portion 30B with a metallic material such as copper and then laser cut the material to form a spiral winding by laser evaporating a spiral pattern of material. The winding 42 is a single larger winding and may, for example, be comprised of 500 turns of metallic material where the material is 0.001 inches wide and where the spacing between adjacent turns is about 0.001 inches. The material may be about 0.001 inches thick.

As an alternative, secondary coil winding 42 could be formed by tightly winding a fine copper magnet wire to the outer surface of tubular portion 30B and then encapsulating the coil winding with a high temperature encapsulation material. By way of example, the wire could be an Awg. No. 44 diameter magnet wire having a diameter of about 0.002 inches.

The coil 42 can be formed of metallic material other than copper, for example, tungsten or silver.

One end of coil winding 42 is connected to shell 34 and hence to electrode 38 by a strip conductor having a portion 44 brazed or soldered to shell 34. The opposite end of winding 42 is connected to the top end of center electrode 32 by strip conductors 46, 48 and 50. Conductor 46 is brazed or soldered to the top end of electrode 32. Conductor 48 extends along an inner surface of portion 30B of insulator 30.

The bore in insulator portion 30B contains a cylindrical magnetic core 52 which is formed of a composite magnetic material. By way of example, core 52 may be comprised of fine particles of powdered iron where each particle is coated with an electrical insulating material that serves to insulate the iron particles from each other. Core 52 may be formed by compacting plastic coated iron particles into a solid mass by suitable pressure and heat. The core 52 is then secured in place in insulator portion 30B by a suitable adhesive such as a ceramic cement.

The unit 18 has an outer protective housing that is formed of a plastic insulating material. This housing encapsulates the upper end of unit 18 and comprises a tubular portion 54 and an integral end cap portion 56. The lower end of portion 54 engages and seals against the top end of shell 34.

There is some clearance between the outer surface of portion 54 and the inner surface of coil spool 24 which is large enough to allow the upper ends of units 18 to be telescoped into coil spools 24 when the module 10 is secured to the engine.

Figure 3:
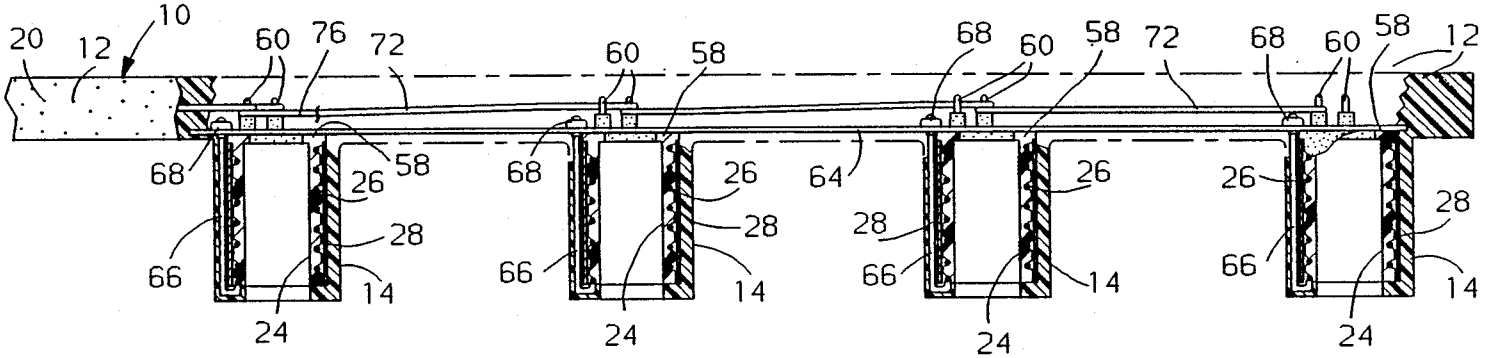
FIG. 3 is a sectional view of a primary winding module.
Figure 4:
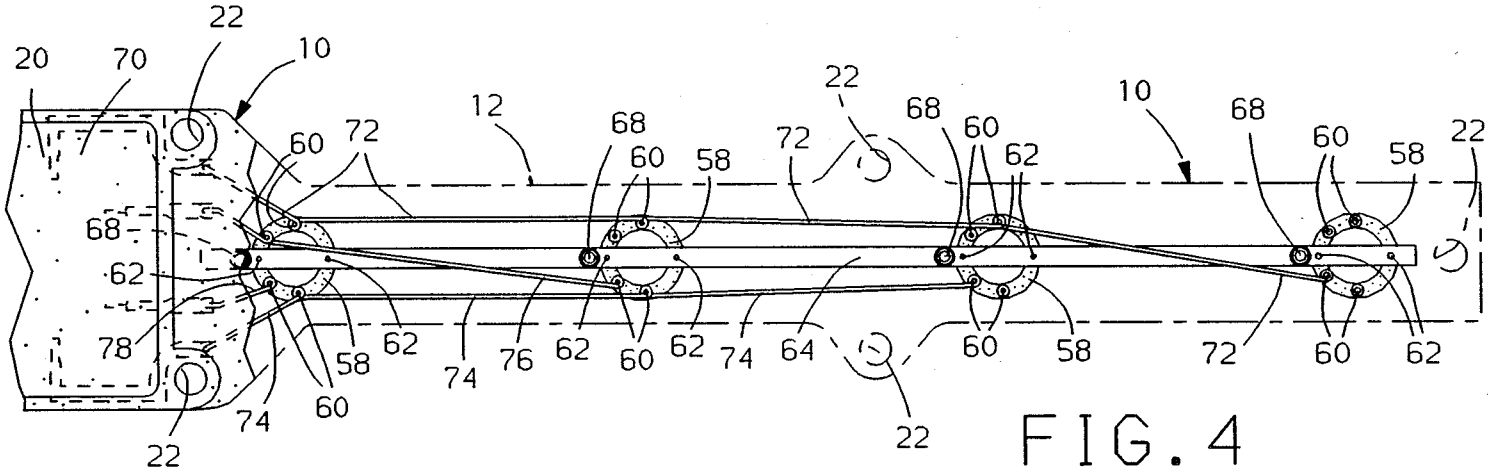
FIG. 4 is a top view of the primary winding module shown in FIG. 3.

Referring now to FIGS. 3 and 4, it is seen that the upper ends of each coil spool has an integral annular portion 58 that each carry four integral posts, each designated as 60. Each annular portion 58 further has a pair of integral projections 62 that extend through openings formed in a conductor strap 64 that is formed of metallic material such as brass. The projections or bosses 62 are headed over to secure respective coil spools 24 to conductor strap 64. The strap 64 should be rigid enough to support the four coil spools prior to overmolding to form molded plastic housing 12.

The conductor strap 64 is connected to one side of all four primary windings 26. To this end, each coil winding 26 has an axially extending end lead or conductor 66. Conductor 66 is an integral extension of coil 26. The conductor 66 projects through an apertured extruded or bumped-out portion 68 of strap conductor 64 and is welded to conductor 64. The strap conductor 64 is connected to an electronic module 70 carried by one end of housing 12.

The opposite ends of the four coil windings 26 are connected by separate conductors or wire to module 70. Thus, one side of the coil winding 26, located at the far right in FIGS. 3 and 4, is connected to module 70 by a conductor or wire 72 that is an integral extension or end lead of one of the coils 26. This wire 72 is led out of a coil spool 24 through a slot formed in annular portion 58. The wire, or conductor 72, has portions respectively wrapped around four posts 60, one from each coil spool to support wire 72. In a similar fashion, the next coil 26 to the left in FIG. 4 is connected to module 70 by wire 74. Another coil 26 is connected to module 70 by wire 76 and the coil 26 at the far left in FIG. 4 is connected to module 70 by wire 78. The wires or conductors 72–78, as well as conductor 64 are shown schematically in the circuit diagram of FIG. 6 which will be described.

In the manufacture of the module 10, the coil spools 24 with attached magnetic parts 28 and wound windings 26 are attached to strap conductor 64. The coil end conductors 72–78 are then positioned with portions thereof being wrapped around posts 60. The conductors 66 are connected to conductor 64. This entire assembly is then overmolded with a plastic insulating material to form the axially extending housing 12 and the integral tubular portions 14. The housing 12 is molded to provide a space for module 70. After the module 70 is assembled in area 20 it is electrically connected to conductors 64, 72, 74, 76 and 78 by suitable terminals. It should be appreciated that conductors 64, 72, 74, 76 and 78 are totally enclosed by the plastic insulating material that forms housing 12.

Figure 5:
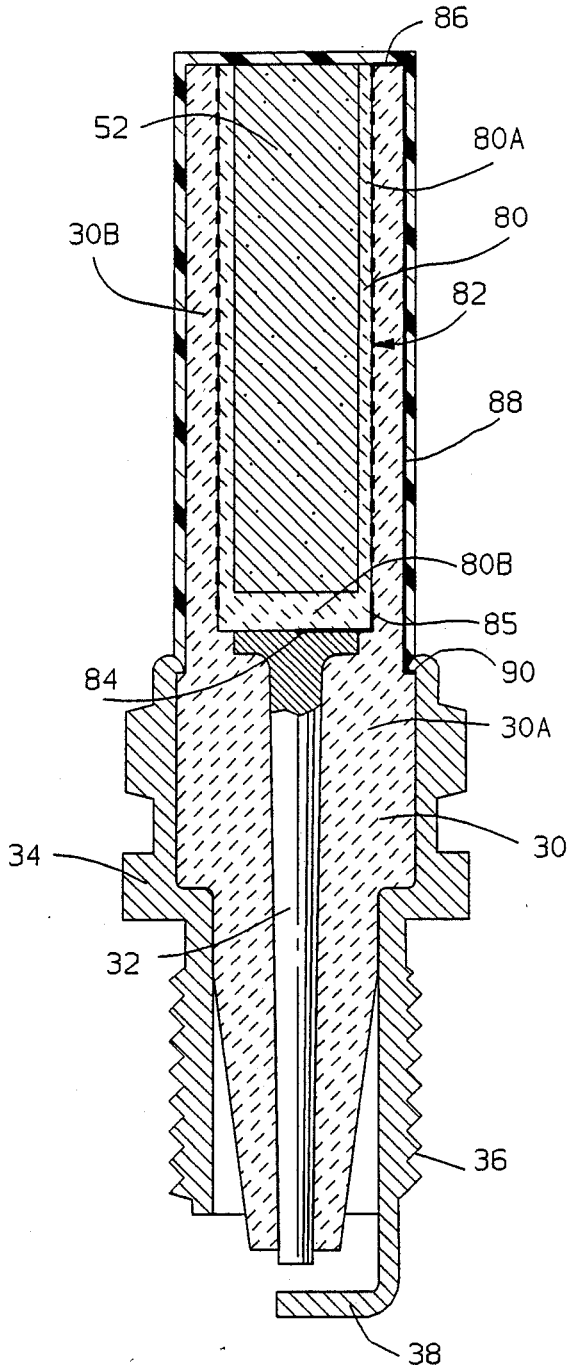
FIG. 5 is a sectional view of a modified secondary unit.

FIG. 5 illustrates a modified secondary unit that can be used in place of the secondary unit 18 shown in FIG. 2. The unit shown in FIG. 5 uses many of the same parts as the unit shown in FIG. 2 and the same reference numerals have been used in FIGS. 2 and 5 to identify corresponding parts.

The unit of FIG. 5 differs from the unit shown in FIG. 2 in that it has an insulator generally designated as 80. The insulator 80 can be formed of ceramic material of the same type that is used for insulator 30. Insulator 80 has a tubular portion 80A and a closed end 80B. The external surface of tubular portion 80A has a spiral secondary coil winding 82 bonded thereto. This winding is of the same type as winding 42 which has previously been described. One end of winding 82 is connected to the top end of electrode 32 by conductor strips 84 and 85. The opposite end of coil 82 is connected to shell 34 by conductor strip portions 86, 88 and 90. Conductor 88 extends axially along the outer surface of insulator portion 30B and portion 90 is connected to shell 34. Insulator 80, with its winding 82, can be secured in insulator portion 30B by a suitable ceramic cement.

The bore of insulator 80 contains a magnetic core 52 which can be the same as core 52 described in connection with the description of FIG. 2. Core 52 is secured in place by a suitable adhesive such as a ceramic cement.

Figure 6:
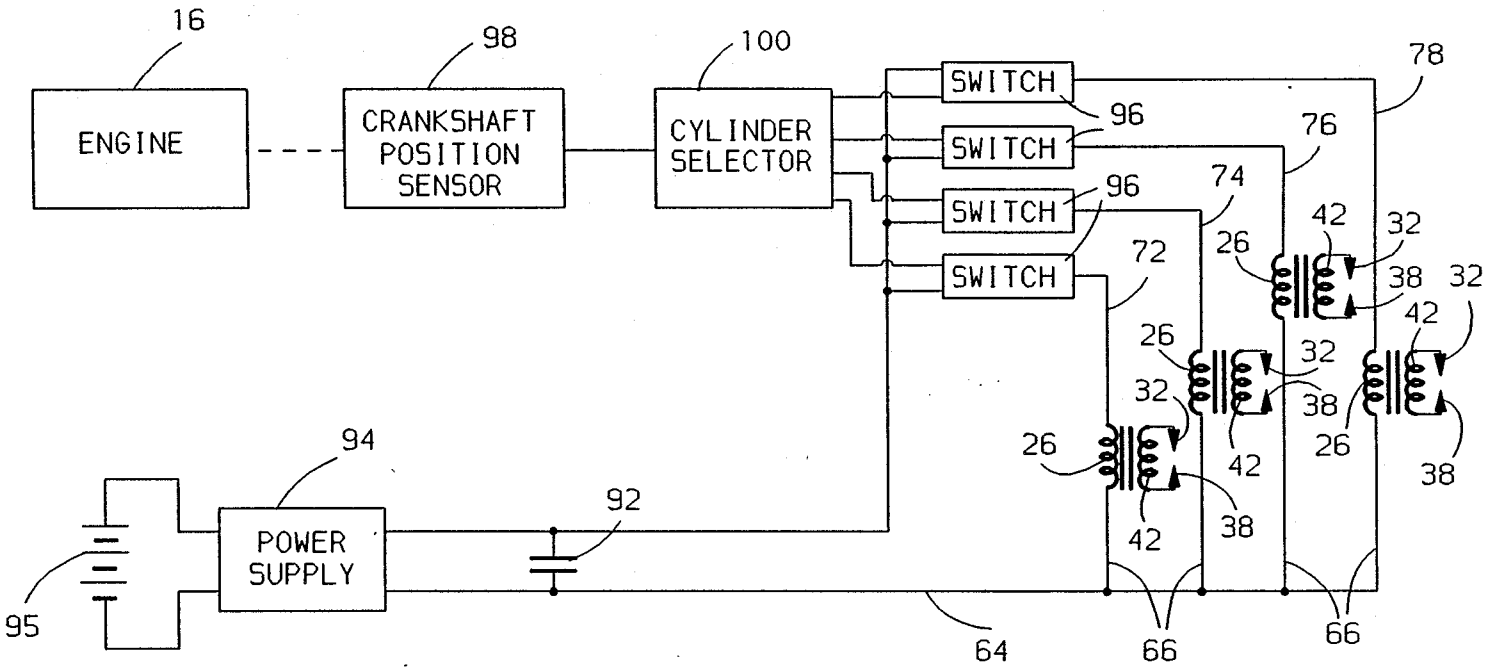
FIG. 6 illustrates a capacitor discharge ignition system for energizing the primary windings of a primary module.

Referring now to FIG. 6, a circuit diagram of a capacitor discharge ignition system is illustrated. In FIG. 6 the same reference numerals have been used as were used in the other figures to identify corresponding elements. It will be assumed that the secondary units 18 of FIG. 2 have been used in FIG. 6.

In FIG. 6, the reference numeral 92 designates a capacitor of a capacitor discharge ignition system. Capacitor 92 is charged to about 400 or 500 volts by a direct voltage power supply 94. Power supply 94 may be a DC to DC converter which is connected to a 12 volt storage battery 95. The power supply 94 boosts the 12 volt input voltage to about 400 or 500 volts output.

One side of capacitor 92 is connected to conductor 64 which in turn is connected to one side of primary coils 26. The opposite side of capacitor 92 is connected respectively to switches 96 which are semiconductor switches such as controlled rectifiers. When a given switch 96 is biased on or conductive the capacitor 92 discharges through one of the primary coils 26. This causes a voltage to be induced in a secondary winding 42 which is high enough to cause a spark arc to be developed across a pair of secondary unit electrodes 32 and 38.

The switches 96 are biased sequentially conductive in synchronism with the angular position of the crankshaft of the engine 16. To this end, the crankshaft of engine 16 drives a crankshaft position sensor 98 that develops pulses of voltage at certain crankshaft angular positions. The sensor 98 is connected to an electronic cylinder selector 100 which in turn has outputs connected respectively to switches 96. With this arrangement, the cylinders of the engine are fired in the correct order and at the correct ignition timing. In this regard, cylinder selector 100 causes switches 96 to be turned on in the proper sequence and as a function of crankshaft angular position.

Power supply 94, capacitor 92, switches 96 and cylinder selector 100 are parts of the electronic module 70 that is supported by one end of module 10.

The head of the engine 16 can be formed to provide spark plug wells that receive the secondary units like unit 18.

No specific hardware has been illustrated for attaching module 10 to engine 16. The hardware can take various forms, depending upon the configuration of engine 16. It will be appreciated that the engine can be provided with mounting brackets that are carried by the engine for accommodating the screws or bolts that pass through openings 22 in housing 10. Further, the shape of housing 12 can be varied to accommodate the shape or configuration of engine 16.

It will be appreciated that when capacitor 92 discharges through a primary winding 26, this winding develops magnetic flux that is coupled to a secondary winding 42. The flux path or magnetic circuit for the flux developed by primary coil 26 includes the low reluctance paths of primary magnetic part 28 and the secondary unit magnetic core 52.

The flux carrying parts 28 can be eliminated if sufficient current is supplied to the primary windings 26 that is high enough to cause a voltage to be induced in a secondary winding that is high enough to cause an arc to be developed across electrodes 32 and 38. If parts 28 are not used, the efficiency of the ignition system is reduced. If parts 28 are not used, the plastic material of tubular portions 14 is molded against outer surfaces of coil spool 24 and primary winding 26.

The embodiments of the invention in which an exclusive property or privilege is claimed are defined as follows:

1. A primary winding ignition module that is adapted to be mounted on an internal combustion engine and which is adapted to be magnetically coupled to a plurality of separate spark developing units associated with the cylinders of the engine comprising, an elongated support, a plurality of spaced tubular members carried by said support, a primary coil winding located in each tubular member having a bore, and conductor means carried by said support connected respectively to opposite ends of a respective primary winding for energizing a respective primary winding, said bores adapted to receive portions of said secondary spark developing units when said module is mounted on an engine.

2. The module according to claim 1 where a tubular flux carrying part formed of magnetic material is located in each tubular member and disposed about a respective primary coil winding.

3. The module according to claim 1 where said elongated support is formed of plastic electrical insulating material.

4. The module according to claim 1 where said spaced tubular members are integral with said elongated support and where the elongated support and tubular members are formed of a molded plastic electrical insulating material.

5. The module according to claim 1 where the primary winding is supported by a spool of electrical insulating material that is located in a tubular member and supported thereby.

6. The module according to claim 1 where the module carries components of a capacitor discharge ignition system that is connected to said conductor means to energize said primary windings.

7. A primary winding ignition module that is adapted to be mounted on an internal combustion engine and which is adapted to be magnetically coupled to a plurality of separate secondary spark developing units associated with the cylinders of the engine comprising, a one-piece part formed of molded plastic insulating material, said one-piece part comprising an elongated support portion and a plurality of spaced tubular portions that are located normal to said support portion, a tubular coil spool located in each tubular portion and supported by a respective tubular portion, a primary coil supported by each coil spool, and conductor means located in said support portion connected respectively to opposite ends of a respective primary winding for energizing a respective primary winding.

8. The module according to claim 7 where each tubular portion has a tubular flux carrying member formed of magnetic material that is disposed about a respective primary coil.

9. Ignition apparatus for developing and applying sparks to a plurality of cylinders of an internal combustion engine comprising, an engine having a plurality of cylinders, a secondary spark developing unit associated with each cylinder, each secondary unit comprising a spark plug and a secondary winding that is connected to the electrodes of the spark plug, a primary winding module supported by said engine, said module comprising an elongated support and a plurality of spaced tubular members carried by said support equal in number to the number of secondary units associated with said engine, a primary coil winding located in each tubular member having a bore, and conductor means carried by said support connected to opposite ends of a respective primary winding for energizing a respective primary winding, said module being so positioned that a portion of a secondary unit that has a secondary winding is located in a respective said bore whereby a spark firing voltage is induced in a secondary winding when a primary winding is energized.

10. The ignition apparatus according to claim 9 where each secondary unit has a magnetic core.

11. The ignition apparatus according to claim 9 where the primary windings are energized by a capacitor discharge ignition system.

12. The ignition apparatus according to claim 9 where said elongated support and tubular members are formed as a one-piece plastic part of plastic insulating material.

* * * * *